United States Patent [19]

Soma et al.

[11] 4,141,646

[45] Feb. 27, 1979

[54] ELECTROPHOTOGRAPHY APPARATUS WITH DOWNTIME CONTROL CIRCUITRY

[75] Inventors: Ikuo Soma, Yokohama; Tamotu Magome, Kawasaki; Yutaka Komiya, Tokyo, all of Japan

[73] Assignee: Canon Kabushiki Kaisha, Tokyo, Japan

[21] Appl. No.: 751,177

[22] Filed: Dec. 16, 1976

[30] Foreign Application Priority Data

Dec. 27, 1975 [JP] Japan ..... 50-156670

[51] Int. Cl.[2] ..... G03G 15/10; G03G 21/00

[52] U.S. Cl. ..... 355/10; 118/646; 355/15

[58] Field of Search ..... 118/646; 355/10, 14, 355/15; 427/15, 16

[56] References Cited

U.S. PATENT DOCUMENTS

| | | | |
|---|---|---|---|
| 3,494,328 | 2/1970 | Maloney | 427/15 X |
| 3,650,196 | 3/1972 | Hosoe et al. | 355/10 X |
| 3,711,796 | 1/1973 | Saito et al. | 355/10 X |
| 3,712,203 | 1/1973 | Kishi et al. | 355/10 X |
| 3,994,257 | 11/1976 | Komori et al. | 118/646 X |

*Primary Examiner*—A. D. Pellinen

*Attorney, Agent, or Firm*—Fitzpatrick, Cella, Harper & Scinto

[57] ABSTRACT

In an image formation apparatus having a developer for developing a latent image on a recording medium by the use of a liquid developer, there is provided a system for determining the length of the downtime by the concentration of the developing liquid after the downtime, and a device responsive to a signal from the system for generating another signal representing the wait time till the time for starting the formation of the latent image.

31 Claims, 20 Drawing Figures

ELECTROPHOTOGRAPHY APPARATUS WITH DOWNTIME CONTROL CIRCUITRY

BACKGROUND OF THE INVENTION

1. Field of the Invention

This invention relates to an image formation apparatus of the liquid development type, and more particularly to such an image formation apparatus in which the wait time preceding the starting of the process is controlled in accordance with the time during which the apparatus was left inoperative (hereinafter referred to as the downtime).

2. Description of the Prior Art

Generally, the liquid developer used for the electrophotography of the transfer type has the property of being fixed when it is dried, and the developer deposited on a photosensitive drum or like object to be developed is dried and fixed to the surface of the drum or the like if the drum or the like is left unused for a long time, so that it becomes difficult to clean the surface of such object to be developed and if cleaned, such surface may be injured during the cleaning thereof. To overcome these problems, there has been adopted a method of providing a predetermined time after the closing of the main switch but before the starting of the copying operation, for example, a time for the surface of the drum or the like to be wet, namely, a wait time. According to this method, a predetermined wait time is required each time the main switch is closed, independently of the surface condition of the drum, and this means a loss of time which is disadvantageous in practice.

There is also known a method of detecting the length of the downtime from the discharging condition of a capacitor and reducing the wait time if the downtime is within one hour or so. This method, however, has the disadvantage that the downtime detectable to reduce the wait time is limited to a short length because of the property of the capacitor.

There is a further problem that the mark imparted to the drum surface by a blade for cleaning the drum surface to make the drum available for repeated use becomes more and more difficult to remove as the downtime is longer, but there is no wait time setting system which has covered such problem.

Also, toner particles in the liquid developer used for electrophotography precipitate with time if the apparatus is left unused, so that the transmittance of the developing liquid becomes thinner with time. Therefore, if copying is effected after a long downtime, there will only be obtained a thin copy image. Consequently, it is not preferable to reduce the wait time in order simply to decrease the loss of time.

SUMMARY OF THE INVENTION

It is an object of the present invention to provide an image formation apparatus of the liquid development type in which, even after a long downtime, a sufficient wait time is secured to ensure good image formation during the next cycle of the electrophotographic process.

It is another object of the present invention to provide an image formation apparatus of the liquid development type which has an optimal wait time.

It is still another object of the present invention to provide an image formation apparatus of the liquid development and transfer type in which the wait time may be of a minimum length in accordance with a long or a short downtime.

It is yet still another object of the present invention to provide an image formation apparatus in which the wait time is set in accordance with the reduction in apparent concentration of the developing liquid which results from precipitation of the toner during the downtime of the apparatus.

It is a further object of the present invention to provide an image formation apparatus such as copying machine, recording machine or printing machine of the type in which an electrostatic latent image formed on a repetitively usable rotatable member is liquid-developed and transferred to a transfer medium and in which the rotatable member is pre-rotated before the starting of the copying process and the time during which the rotatable member is rotated is determined in accordance with the concentration of the developing liquid.

It is a further object of the present invention to provide an image formation apparatus in which the wait time is determined by the reduction in apparent concentration of the developer resulting from the precipitation of the toner particles during the downtime of the apparatus and the wait time so set is sufficient at least for the concentration to recover.

The invention will become more fully apparent from the following detailed description thereof taken in conjunction with the accompanying drawings.

BRIEF DESCRIPTION OF THE DRAWINGS

FIGS. 2-1, 2-2(*a–c*) graphically illustrate the relation between the transmittance of the developing liquid and the downtime and the stirring time.

FIGS. 3-1, 3-2 show concentration discriminating means in the present invention.

FIGS. 4-1, 4-2 diagrammatically show an example of the wait time control circuit in the present invention.

DESCRIPTION OF THE PREFERRED EMBODIMENTS

Figure 1:
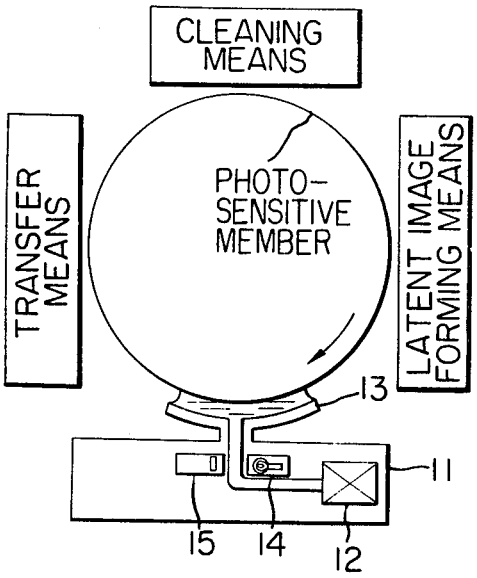
FIG. 1 is a schematic view illustrating the process in an electrophotographic copying apparatus.

Referring to FIG. 1, there is schematically shown a process in an electrophotographic copying apparatus for use in offices. This process includes the steps of rotating a drum-shaped photosensitive medium in the direction of the arrow, forming an electrostatic latent image on the photosensitive medium, developing the latent image, transferring the toner image onto plain paper, and cleaning the photosensitive medium for re-use, and these steps are repeated thereafter. From a developing device 11 containing developing liquid therein, the developing liquid is supplied to a developing dish 13 by means of a pump 12. The developing liquid within the developing device 11 is also stirred by the pump 12. A lamp 14 and a CdS cell 15 are provided along the supply path to detect the concentration of the developing liquid.

Figures 1, 2:
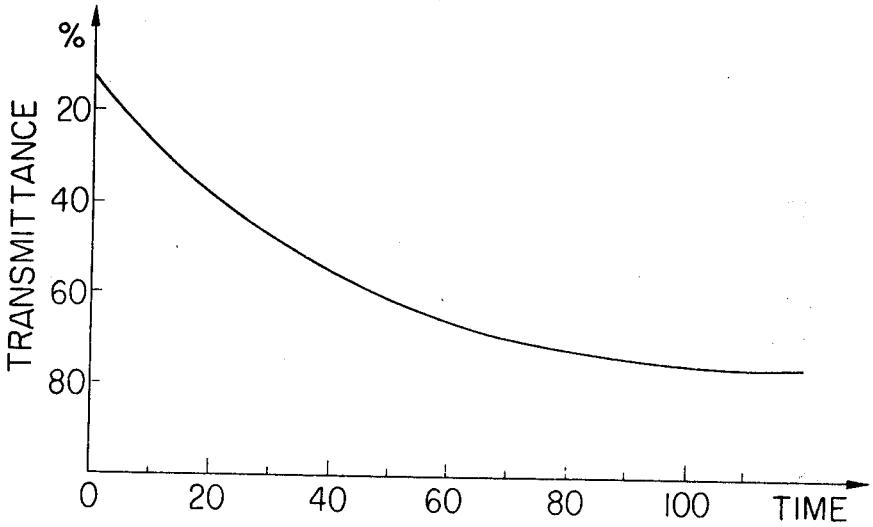
Figures 2, 2A:
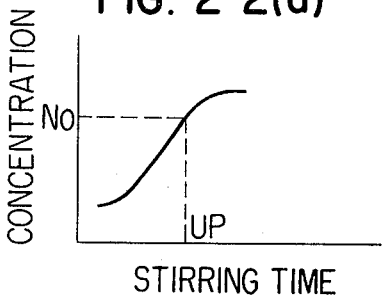
Figures 2, 2B:
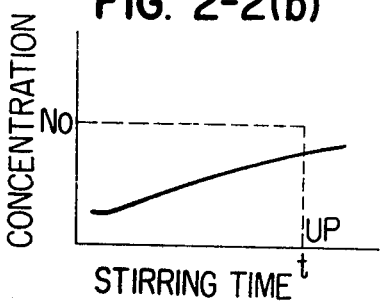
Figures 2, 2C:
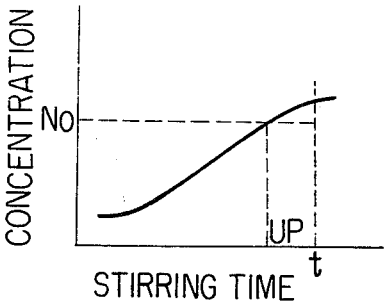

FIG. 2-1 illustrates the relation between the time (in hours) during which the pump 12 is left inoperative and the concentration of the developing liquid. As seen in FIG. 2-1, the apparent transmittance is decreased in accordance with the downtime of the apparatus. This is because the toner particles in the developing liquid gradually precipitate. More specifically, the transmittance increases to 40% in twenty-four hours.

The present invention is based on the recognition of such phenomenon. For example, where the referential transmittance for setting the wait time is approximately 40%, instant start of the apparatus may take place if the apparatus has been left inoperative within one day, and the copying operation may be started after the wait time if the apparatus has been left inoperative for longer than one day. Therefore, if the apparatus is used every day, it always permits instant start and the wait time is required only at the beginning of the day after the day on which the apparatus was not used (Sunday or other holiday), and this is practically an instant start. Also, as seen in FIGS. 2-2(*a–c*), if the apparatus has been left inoperative for a long time, a minimum necessary wait time may be set with the aid of stirring. FIGS. 2-2(*a*) and (*c*) show the cases where the wait time is up with a recovered concentration No signal, and FIG. 2-2(*b*) shows a case where the wait time is up after the lapse of the time set by a timer.

There is also a method whereby the length of the wait time may be varied by providing a plurality of set concentrations for determining the time during which the apparatus has been left inoperative. That is, where it is preferred to vary the wait time in accordance with the ambient temperature, humidity, etc., different lengths of wait time may be preset in accordance with different set concentrations so that these set concentrations may be selected in accordance with those factors, whereby there may be provided different lengths of wait time. This method is particularly convenient for the apparatus to recover from its declined function which resulted from the low temperature of the developing liquid and the high temperature of the photosensitive medium. It is also possible that the wait time is up when the recovered concentration of the liquid has reached the referential concentration for determining how long the apparatus has been left inoperative.

The means for detecting the concentration of the developing liquid may be used also as the detector means for automatic toner supply.

Figure 15:
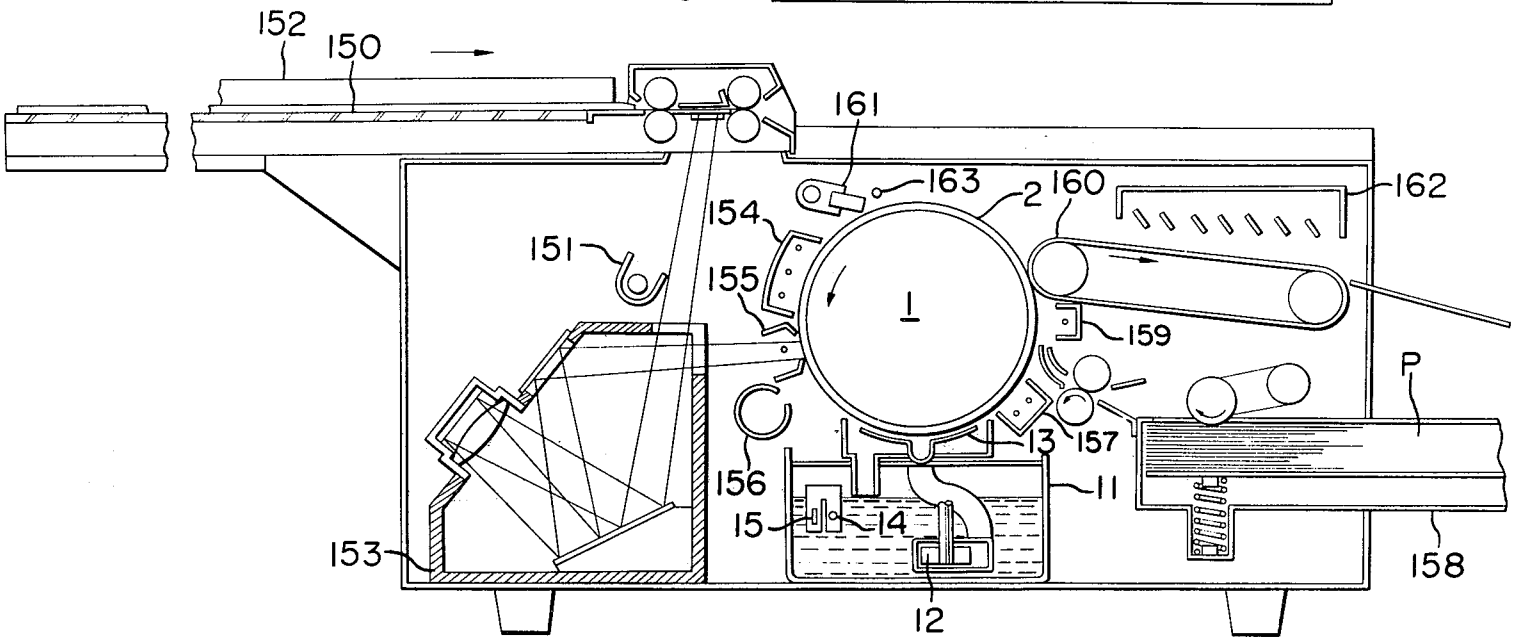
FIG. 15 is a schematic cross-sectional view of the electrophotography apparatus of the liquid development and transfer type according to the present invention.

The invention will more fully be described hereinafter. FIG. 15 shows, in cross-section, an electrophotographic copying apparatus of the liquid development and image transfer type which performs the process of FIG. 1 as an example of the image formation apparatus according to the present invention.

After the main switch is closed, depression of a copy button (not shown) causes rotation of a drum 1 and in a predetermined time thereafter, an original carriage 150 starts to move in the direction of the arrow so that an image original 152 is illuminated by an illumination lamp 151. During the forward stroke of the original carriage 150, the image of the original is scanned by an optical system 153 and projected upon a photosensitive medium 2 (comprising an insulating layer, a photoconductive layer and a conductive layer in order from the surface of the medium). Since the photosensitive medium is subjected to a primary charge in advance by a primary corona charger and with the aid of the rotation of the drum started by the depression of the copy button, there is formed on electrostatic latent image on the photosensitive medium by the action of an AC corona charger 155 and the projection of the image. Thereafter, the latent image is subjected to the whole surface exposure by a lamp 156 to thereby provide a latent image with high contrast. This latent image is developed as described in connection with FIG. 1, whereafter any excess developing liquid is squeezed from the developed image by a charger 157, and then the developed image is transferred onto a sheet of paper P supplied from a cassette 158, by a transfer charger 159. Thereafter, the transfer paper P is separated from the photosensitive medium and conveyed on a belt 160 while the toner on the paper is fixed by a heater 162. After the image transfer, any residual toner on the photosensitive medium is removed therefrom by a cleaning blade 161 urged against the photosensitive medium, whereby the photosensitive medium becomes usable for another cycle of latent image formation. It is to be noted here that the closing of the main switch also drives a pump 12 to supply the liquid through a pipe 163 to the area of contact between the cleaning blade and the photosensitive medium. By this, the solidified toner in that area is dissolved to prevent the photosensitive medium from being injured and accomplish perfect cleaning thereof. This operation takes place during the rotation of the drum in the wait time after closing of the main switch and in the wait time after depression of the copy button. A lamp 14 and a light receiving element 15 for detecting the concentration of the liquid are submerged in a container 11. By these, the absence of the liquid may also be known.

Setting of the wait time will now be described by reference to FIGS. 3-1, 3-2 and so on.

Figures 2, 3:
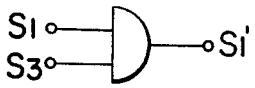
Figures 1, 3:
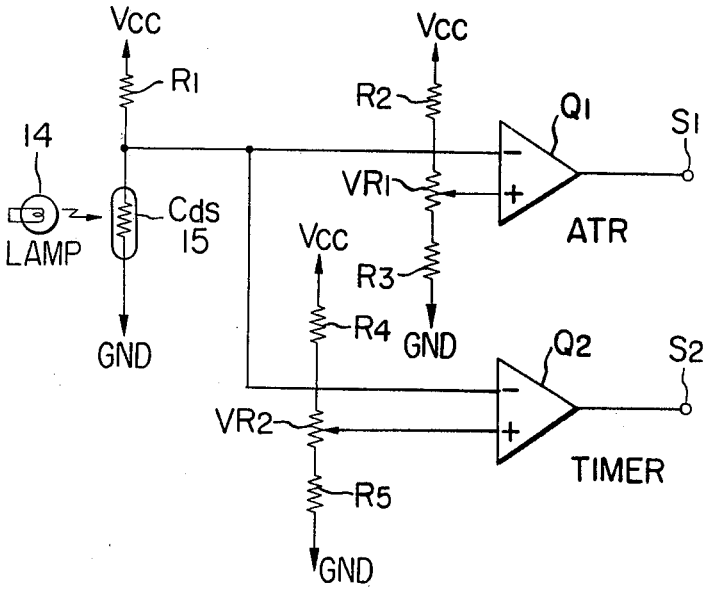

FIG. 3-1 diagrammatically shows a circuit for discriminating the concentration of the developing liquid. Q1 is a first concentration detecting circuit for the automatic toner supply means using an operational amplifier, and Q2 is a second concentration detecting circuit using an operational amplifier and sharing the detecting portion (lamp 14 and light receiving element 15) with the first detecting circuit but having a different detection level from that of the first detecting circuit. The first concentration detecting circuit Q1 detects the concentration of the developing liquid by the level of the voltage from the light receiving element such as CdS cell or the like and when such voltage level becomes lower than the potential set by resistors R1, R2 and VR1, the output of the first detecting circuit Q1 becomes "1" so that the supply signal S1 assumes the logic level "1", thus operating the unshown supply device to supply toner or concentrated liquid. The second detecting circuit Q2 has its detection level set to a little lower concentration than that for the first detecting circuit. When the apparatus is left inoperative for a long time, the toner particles precipitate to greatly decrease the concentration of the developing liquid, as already noted. In such a case, therefore, the output signal S2 from the second concentration detecting circuit assumes the logic level "1" until the set concentration is restored with the aid of the stirring by the pump.

Figures 1, 4:
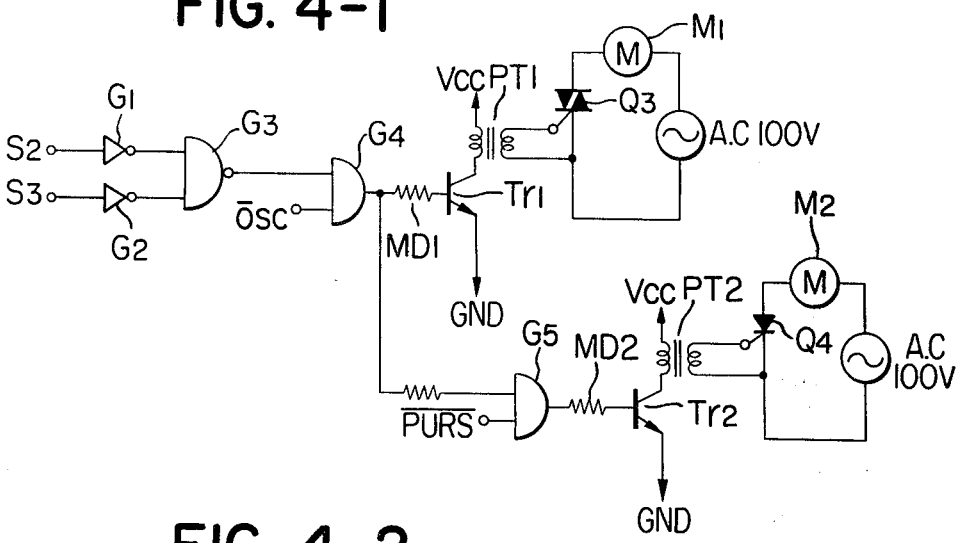
Figures 2, 4:
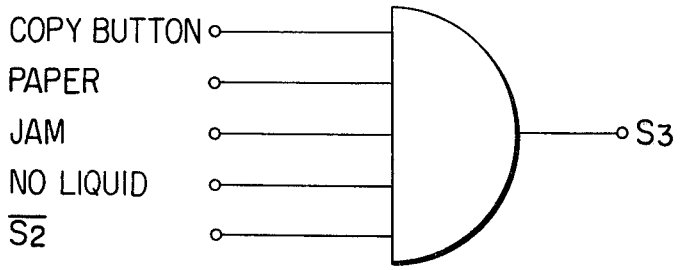
Figure 5:
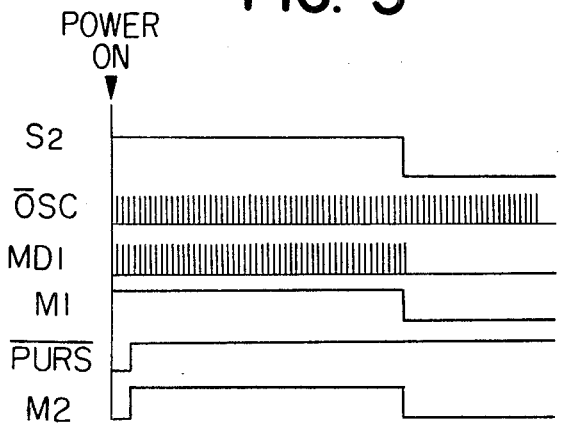
FIG. 5 is a time chart therefor.

FIG. 4-1 shows an example of the circuit corresponding to FIG. 2-2(*a*) in which the wait time is controlled by the output S2, and FIG. 5 is a timing chart for various points in the circuit of FIG. 4-1. After closing of the main switch, the output signal S2 from the second concentration detecting circuit is inverted by an inverter G1 and applied to one input of a gate G3. Another signal S3 which assumes the level "1" when a regular copying cycle is entered is inverted by an inverter G2 and applied to the other input of the gate G3. This signal S3 is put out in response to the input signals as shown in FIG. 4-2. These input signals are a signal which assumes "1" as long as the copy button is depressed, a signal which assumes "1" when transfer paper is present in the cassette, a signal which assumes "1" when transfer paper is not jamming in its path, a signal which assumes "1" when developing liquid is present in the container, and a signal which assumes "1" when the concentration of the developing liquid is higher than the second concentration level. Therefore, even if the copy button is depressed, the signal S3 will not assume "1" unless all the other conditions are satisfied.

Thus, the output of the gate G3 is "1" whichever of the signals S2 and S3 may assume "1". Now, when the signal S2 is at the level "1" after closing of the main switch, the output of the gate G3 is at the level "1" and applied to one input of a gate G4. Since an oscillation signal OSC as shown in FIG. 5 is being applied to the other input of the gate G4, the output signal MD1 from the gate G4 provides an oscillation signal as shown in FIG. 5. This output, on the one hand, drives a transistor $Tr_1$ and on the other hand, triggers a triac Q3 through a pulse transformer PT1 to operate a motor M1 (pump 12) for the developing device. Designated by $\overline{PURS}$ is a "0" signal for resetting the entire circuit when the main switch is closed, and this signal is generated for 4 to 5 seconds. However, the pump in the developing device is operated even during the period when $\overline{PURS}$ is at "0" so that the pump may be started to operate from the time of closing of the main switch. Thus, before the drum begins to rotate, the pump 12 pumps up the developing liquid to the area of contact between the cleaning member (blade 161) and the drum to dissolve or soften the solidified toner present in said area of contact, thereby eliminating the possibility of the drum and blade being injured when the drum is rotated. Then, the output of gate G5 takes the AND of the output signal from G4 and the $\overline{PURS}$ and operates the drum driving motor M2 with the timing as shown in FIG. 5. When the developing device motor M1 is operated and the pump begins to stir the developing liquid, the concentration of the developing liquid soon recovers its set concentration level, whereupon the output signal S2 from the second concentration detecting circuit assumes the logic level "0", so that the motors for driving the developing device and the drum are stopped and the wait is up. The circuit is designed such that the signal S3 remains at "0" during this period of time (as already noted). By the signal S2=1, a lamp provided on the panel of the apparatus is turned on to indicate that the wait time is going on.

Then, by the signal S3=1, the pump is again operated while the drum is rotated and the primary charging and exposure are started. It is to be noted that before the exposure is started, the drum effects one complete rotation for its surface to be cleaned. During the period when S2=1, the control operation for the predetermined concentration does not take place even if the concentration of the developing liquid is low. More specifically, by the concentration signal below the second level and the reset signal, namely, the operating signal of the drum motor M2, the output of S1 is blocked in the manner as shown in FIG. 3-2 to prevent the supply of the developing liquid. Normally, the concentration of the developing liquid can be recovered to the detection level of the second concentration detecting circuit with the aid of stirring and at the same time, copying can be started, but if the toner supply fails to be properly effected for some reason or other, the concentration may not be recovered even with the aid of stirring. In such a case, the signal S3 representing the regular copying cycle may not assume "1" for ever and accordingly, copying may not take place.

Figure 6:
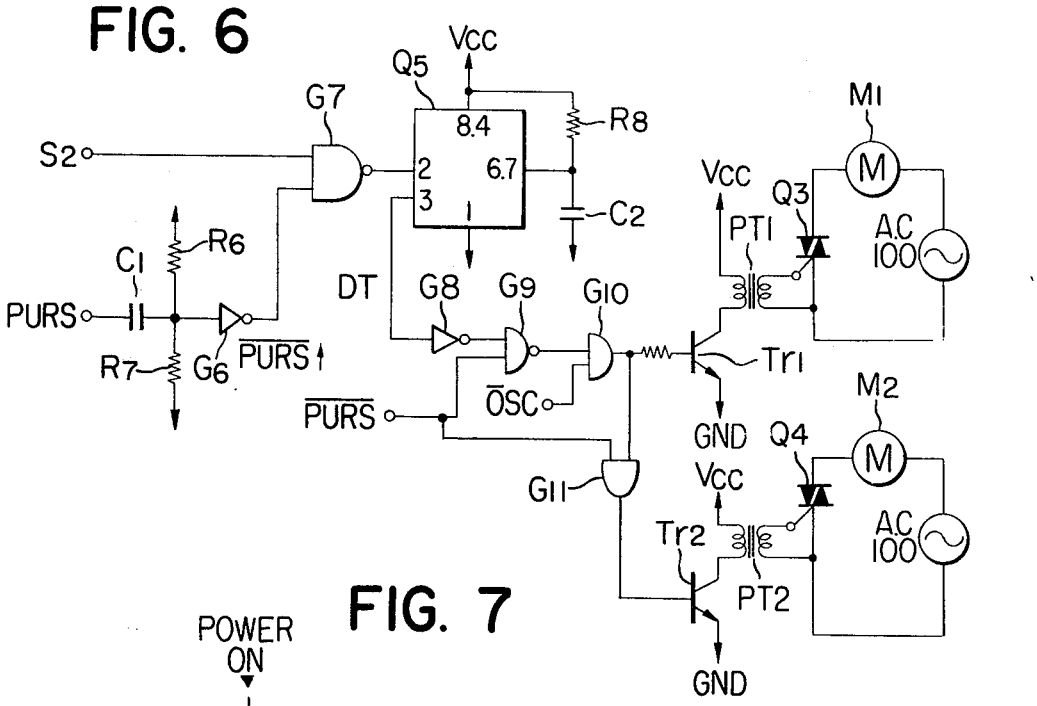
FIG. 6 diagrammatically shows another example of circuitry for the present invention.
Figure 7:
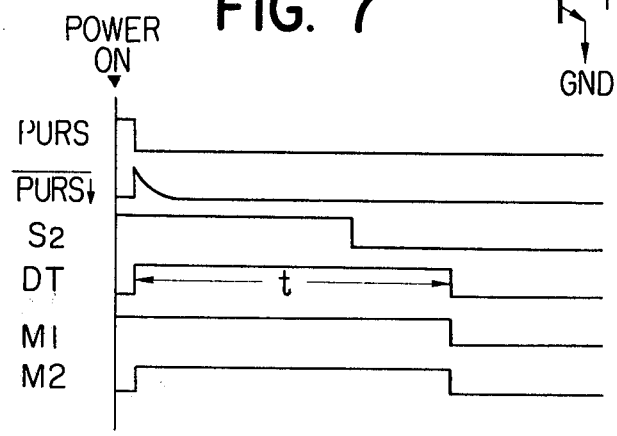
FIG. 7 is a time chart therefor.
Figure 9:
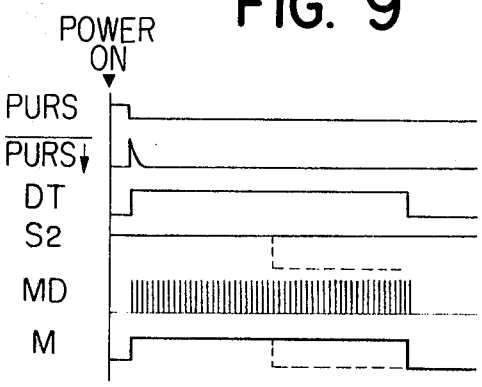
FIG. 9 is a time chart therefor.

The circuit shown in FIG. 6 carries out the method of bringing about the "wait up" in a predetermined time, and this corresponds to the case of FIG. 2-2(*b*). Describing it by reference to the timing chart of FIG. 7, the signal PURS is at "1" at the time of closing of the main switch, and at the end of this signal, a short pulse is produced to sample the signal S2 from the second concentration detecting signal, set the timer circuit, operate the motor M1 to stir the developing liquid for a predetermined time and disperse the precipitated toner particles, and clean the drum surface, whereupon the wait time is up. Thereafter, toner is supplied by the signal S1 of FIG. 3-1 to recover the predetermined concentration of the developing liquid. Q5, which is a well-known integrated circuit used as the timer circuit, is such that when the No. 2 terminal thereof is triggered by the output from G7, the No. 3 terminal assumes "1" for the timer time t determined by a resistor R8 and a capacitor C2. Sufficient stirring is effected when t becomes about 60 seconds. Thus, the wait time need not be unduly long and may be sufficient even if the recovery of the concentration is obtained too early. The circuit of FIG. 6 enables quick start, provided that the concentration is above a predetermined level even if the apparatus has been left inoperative, and it can achieve the intended purpose to some extent, but if the apparatus has been left inoperative for a long time, the recovery of the concentration to the predetermined level is slow and thus, there is always a predetermined wait time after the closing of the main switch.

Figure 8:
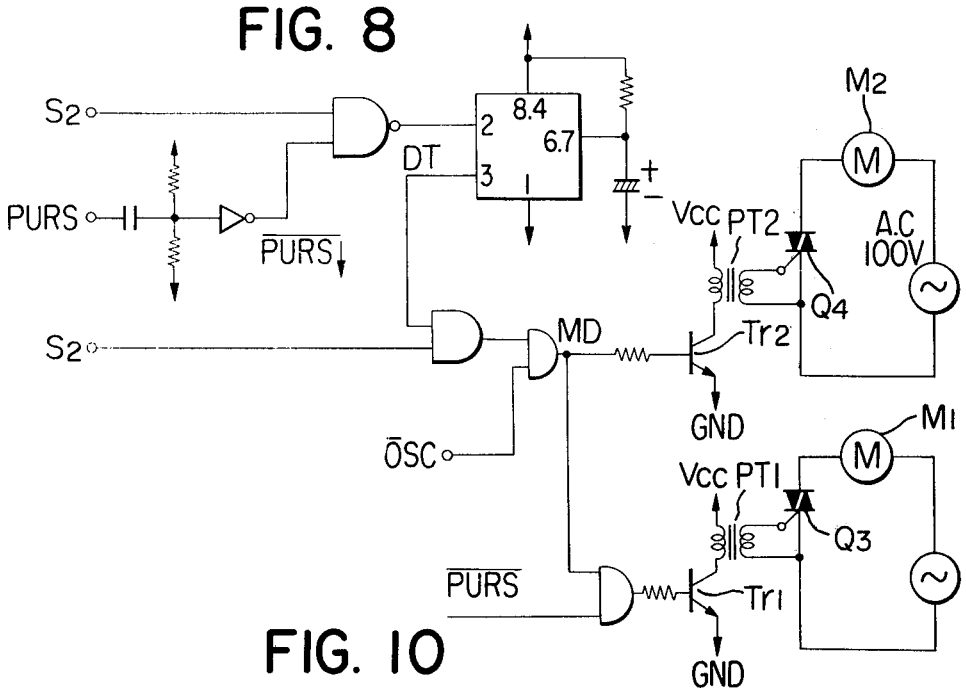
FIG. 8 diagrammatically shows a further example of circuitry for the present invention.

A circuit improved in this point is shown in FIG. 8. In this circuit, the AND of the output signal DT from the trigger circuit described in connection with FIG. 6 and the signal S2 from the second concentration detecting circuit is taken so that, if the concentration recovers within the timer time, the signal S2 assumes "0" to bring about the "wait up" and that even if the concentration does not recover within the timer time for some reason or other, the "wait up" is brought about in a predetermined time. This corresponds to FIG. 2-2(*c*).

More specifically, in FIG. 6, the reset signal PURS resulting from the closing of the main switch continues for about 4 seconds, whereafter detection of the concentration takes place. If the concentration detected is below the second level, the drum motor is driven for 50 seconds to effect several complete pre-rotations of the drum. Thereafter, the copying process will be entered if the copy button was already depressed. On the other hand, if the concentration detected is above the second level, the drum motor is driven for 25 seconds to effect some complete pre-rotations of the drum. Thereafter, the copying process will be entered if the copy button was already depressed.

During the rotations of the drum, liquid is supplied to the developing dish and the blade by the pump so that the drum surface can be cleaned in its wet state to completely remove the mark imparted to the drum surface by the blade. The liquid supplied to the area of contact between the blade and the photosensitive medium may also be cleaning liquid and this may be supplied only during the wait time. Where the developing liquid from the pump is supplied to said area of contact, the supply may be discontinued at the start of the copying process.

FIG. 15 shows an example of the apparatus in which, even after the paper has been discharged at the end of the copying process, the drum continues to effect several complete rotations so that the residual toner on the drum surface may be removed by the blade before the toner is dried.

In the apparatus of FIG. 15, an AC charger is operated during the aforementioned pre- and post-rotations of the drum to electrically discharge the photosensitive medium, thereby providing an image free of irregularity of charging. It is also possible to apply the light from the whole surface exposure lamp or the original illumination lamp to the drum surface simultaneously with said AC charging to thereby enhance the effect of the charging.

Figure 10:
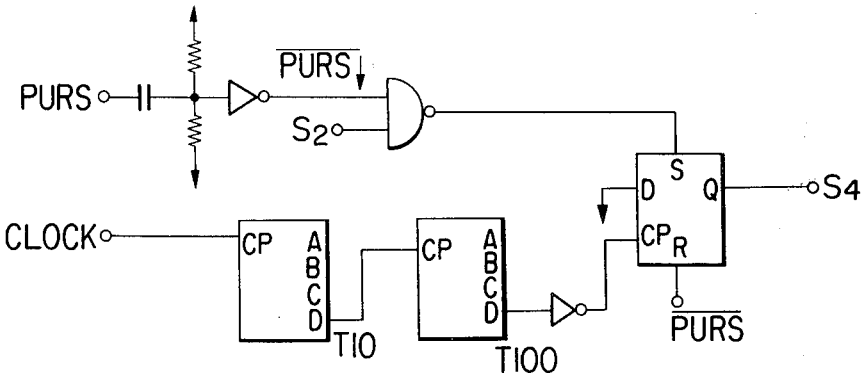
FIG. 10 diagrammatically shows an example of the timer circuit in the present invention.
Figure 11:
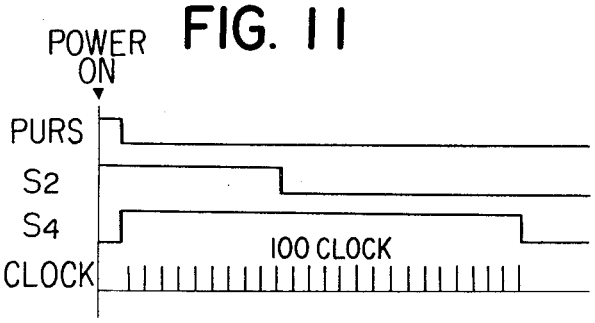
FIGS. 11 and 12 are time charts therefor.
Figure 12:
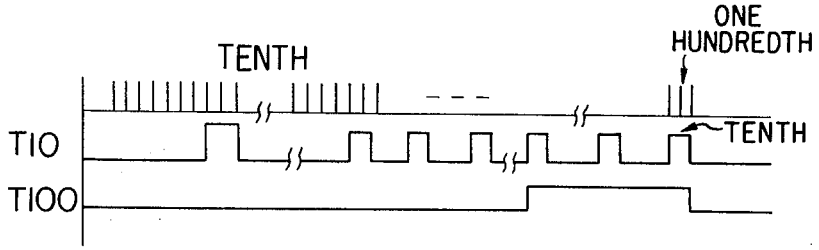

FIG. 10 shows a circuit in which the timer circuit of FIG. 6 or 8 is digitalized on the basis of drum rotation, and this circuit can perform the time limiting more accurately than the CR timer. The clock pulse signal is generated in synchronism with the drum and assuming that ten clock pulses are generated for one complete rotation of the drum, the circuit is a clock timer (the output of which is S4) corresponding to ten complete rotations of the drum. Alternatively, use may be made of clock pulse generating means independent of the drum, and the number of clock pulses may be as desired. FIGS. 11 and 12 are the time charts for the various outputs of the timer of FIG. 10.

Description has hitherto been made of the operation control during the wait time of the developing device motor M1 and the drum motor M2, but it is also possible to made such a design that the developing device motor is operated at all times independently of the wait time while the drum motor is operated during the wait time at the closing of the main switch, whereafter the copy button is depressed to rotate the drum before the copying process is started and after the copying process is completed, and the rotation of the drum before the starting of the copying process may be started by the signal representing the recovered concentration of the developing liquid.

Figure 13:
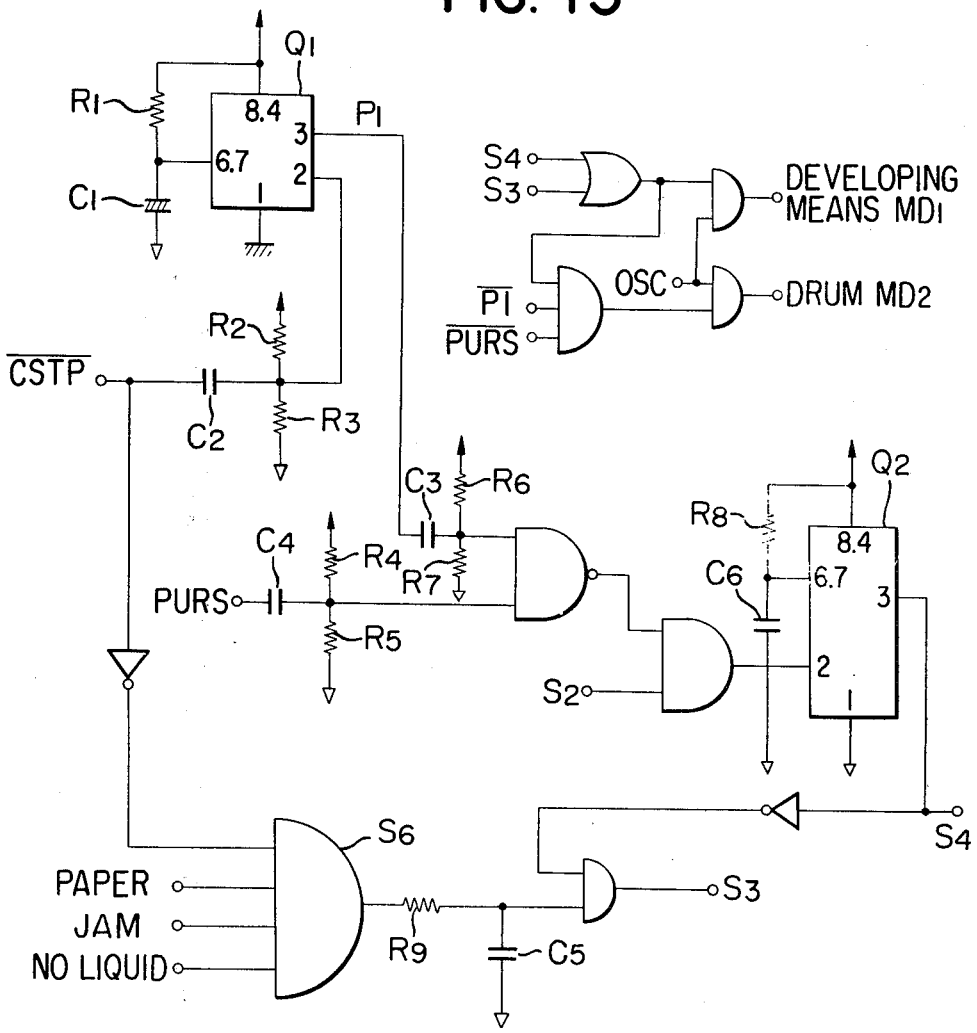
FIG. 13 diagrammatically shows an example of the wait time control circuit associated with the copy button in the present invention.
Figure 14:
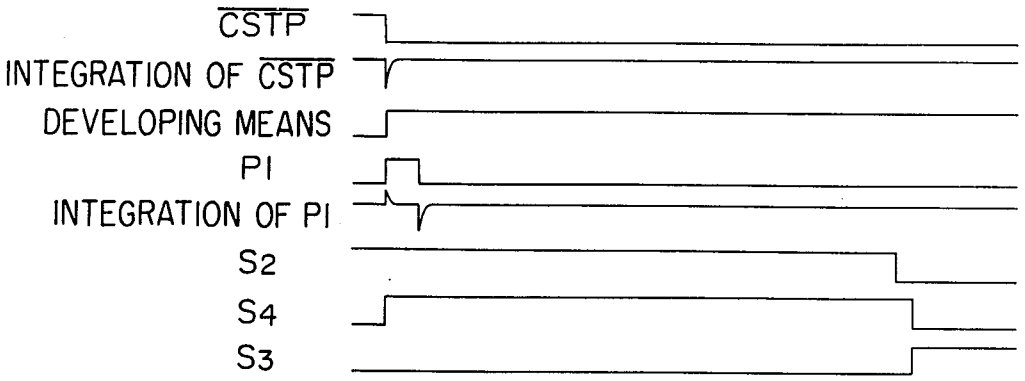
FIG. 14 is a time chart therefor.

Usually, nobody would not leave the apparatus with its main switch closed, but should such state happen, some wait time must be provided before the copying is started. The control circuit therefor is shown in FIG. 13 and the time chart therefor is illustrated in FIG. 14.

When the copy button is depressed, there is produced a signal CSTP and one-shot multivibrator Q1 is triggered by the differentiated waveform of the signal $\overline{\text{CSTP}}$ to thereby generate a short signal P1. With the timing with which the differentiated signal of the inverted signal of the P1 or the differentiated signal of the PURS is generated, the timer IC, namely, Q2, is operated to generate a wait signal S4 if the concentration of the developing liquid is lower than the second level (namely, when S2=1). The wait display lamp is turned on by the signal S4. On the other hand, depression of the copy button generates a copy executing signal S6 but this signal is delayed by a delay circuit comprising a resistor R9 and a capacitor C5. If the wait signal is generated during that time, the copy signal S3 is suppressed. Thus, during this wait time, the drum effects several complete rotations so that the surface thereof is cleaned to remove the mark of the blade therefrom. Simultaneously therewith, the concentration of the developing liquid recovers. This timer means may of course be replaced by the clock timer of FIG. 10.

In the examples described above, the concentration detecting lamp 14 is turned on during the period PURS=1 or the period during which the motor M1 is in operation, that is, detection of the concentration can not take place during the stand-by condition, thereby preventing any malfunctioning which would otherwise result from detection of a low concentration.

The wait time is controlled in the manner as described above and this enables the length of the downtime of the apparatus to be freely detected if it is within the range from one hour to one week or more.

Also, the number of revolutions of the developing device motor during the wait time may be greater than that during the copying, thereby bringing about the "wait up" earlier.

Further, the present invention is not restricted to the so-called copying machines but it applicable to any apparatus which is provided with liquid developing means.

In addition, the present invention can completely remove the mark imparted to the photosensitive medium by the toner fixed to the cleaning blade during in downtime of the apparatus and this is highly effective for the cases where the photosensitive medium is in the form of an endless drum or belt. In the present invention, it is also possible to make the wait time constant in accordance with the downtime while increasing the velocity of each rotation of the drum.

What we claim is:

1. An image formation apparatus comprising:

image forming means including means for forming a latent image on a recording member and means for developing the latent image with a liquid developer;

means for detecting the concentration of the developer;

means for generating a signal which corresponds to the downtime of the image formation apparatus using the concentration of developer detected by said detecting means; and means for controlling said image forming means in response to the signal generated by said signal generating means.

2. An apparatus according to claim 1, wherein said controlling means controls a time period, in accordance with the downtime, measured from the time when a power switch for the apparatus is turned on to the time when operation of said image forming means is enabled.

3. An apparatus according to claim 1, wherein said controlling means controls a time period, in accordance with the downtime, measured from the time when an instructing signal for the start of the image forming operation is generated to the time when the start of the image forming operation is allowed.

4. An apparatus according to claim 1, wherein said controlling means controls said image forming means in a first control mode when the detected signal is lower than a predetermined value, and controls such image forming means in a second control mode when the detected signal is higher than the predetermined value.

5. An apparatus according to claim 1, wherein said recording member is a rotatable member which is subjected to a latent image forming operation, a developing operation, an image transfer operation and a cleaning operation, and wherein said controlling means controls the cleaning operation of the rotatable recording member before the start of the image forming operation.

6. An apparatus according to claim 1, wherein said recording member is a rotatable member which is subjected to a latent image forming operation, a developing operation and an image transfer operation, and is rotated before the start of the image forming operation, and wherein said controlling means controls the rotation of said recording member before the start of the image forming operation.

7. An apparatus according to claim 1, wherein said recording member is a rotatable member which is subjected to a latent image forming operation, a developing operation, an image transfer operation, and wherein a wetting means wets the surface of said recording member before the start of the latent image forming operation, and wherein said controlling means controls the rotation of said recording member before the start of the image forming operation.

8. An apparatus according to claim 1, further comprising means for stirring the developer before the latent image forming operation, said control means controlling said stirring means.

9. An apparatus according to claim 1, further comprising means for supplying toner to the developer in accordance with the concentration detected by said detecting means after said apparatus is put into operation.

10. An apparatus according to claim 1, wherein said recording member in a rotatable member which is subjected to a latent image forming operation, a developing operation and an image transfer operation; said apparatus further comprising a cleaning blade for cleaning a surface of said recording member for repetitive use, wetting means for wetting the surface of said recording member, and means for rotating said recording member before the start of the latent image forming operation, said controlling means controlling said rotating means and said wetting means to rotate, for a predetermined period of time, said recording member before the start of the latent image forming operation to allow said cleaning blade to clean, when the developer concentration is not more than a predetermined value, the surface of said recording member as the surface is wetted.

11. An apparatus according to claim 10, wherein said controlling means stops said rotation when the developer concentration returns to the predetermined value.

12. An image formation apparatus comprising:

a rotatable member;

means for forming a latent image on said rotatable member;

means for developing the latent image with a liquid developer;

means for transferring the image developed by said developing means onto a transfer material;

means for pre-rotating said rotatable member to make the surface condition thereof uniform;

means for detecting the concentration of the liquid developer;

means for controlling said pre-rotating means in response to the downtime of the image formation apparatus in accordance with the concentration of the developer detected by said detecting means.

13. An apparatus according to claim 12, further comprising means for cleaning a surface of said rotatable member before the latent image formation operation, wherein said controlling means controls the time period of pre-rotatation of said rotatable member to effect cleaning on the surface in accordance with the downtime.

14. An apparatus according to claim 12, further comprising cleaning means for cleaning a surface of said rotatable member and means for wetting the surface of said rotatable member before the latent image formation operation, said controlling means including means for controlling the operation time of said wetting means.

15. An apparatus according to claim 14, wherein said controlling means controls the time period of pre-rotation of said rotatable member in accordance with the downtime measured from when a main switch of the apparatus is turned off to when the main switch is turned back on.

16. An apparatus according to claim 14, wherein said controlling means controls the time period of pre-rotation of said rotatable member in accordance with the downtime between image forming instructions.

17. An apparatus according to claim 12, further comprising means for supplying toner to the developer in accordance with the concentration detected by said detectng means after said apparatus is put into operation.

18. An image formation apparatus comprising:

a rotatable member;

means for forming a latent image on said rotatable member;

means for developing the latent image into a developed image with a liquid developer;

means for transferring the developed image onto a transfer material;

means for cleaning, for repetitive use, said rotatable member after the transfer of the developed image onto the transfer material;

means for wetting said rotatable member before the formation of the latent image;

means for pre-rotating said rotatable member before the latent image formation operation;

means for detecting the downtime of the apparatus by detecting the concentration of liquid developer; and means for controlling said wetting means in accordance with the downtime detected by said detecting means.

19. An apparatus according to claim 18, wherein said cleaning means includes a cleaning blade, and said wetting means includes means for supplying developer to the surface of said rotatable member adjacent to said cleaning blade, and wherein said controlling means controls the operating time of said supplying means and the pre-rotating time of said rotatable medium in accordance with the downtime to allow said rotatable member to be wet-cleaned.

20. An apparatus according to claim 19, further comprising a pump effective to supply developer to a developing station and also to the surface of said rotatable member adjacent to said cleaning blade.

21. An apparatus according to claim 19, wherein said controlling means controls the time period of the pre-rotation of said rotatable member in accordance with the downtime measured from when a main switch is turned off to when the main switch is turned back on.

22. An apparatus according to claim 19, wherein said controlling means controls the time period of the pre-rotation of said rotatable member in accordance with the downtime between image forming instructions.

23. An apparatus according to claim 18, further comprising means for supplying toner to the developer in accordance with the concentration detected by said detecting means after said apparatus is put into operation.

24. An image formation control device for an image formation apparatus having means for developing a latent image formed on a recording member with a liquid developer; comprising:

means for detecting the concentration of the liquid developer;

means for replenishing toner to the developer to maintain the concentration of the developer at a predetermined value; and means for controlling the start of the latent image forming operation in accordance with the downtime of the apparatus obtained from the concentration of the developer detected by said detecting means.

25. A device according to claim 24, wherein said replenishing means replenishes toner when said detecting means detects a developer concentration not more than a first predetermined value, and said controlling means delays the start of the latent image forming operation when said detecting means detects a developer concentration not more than a second predetermined value before the start of the latent image forming operation.

26. A device according to claim 24, wherein said recording member is a rotatable member which is subjected to a latent image forming operation, a developing operation, an image transfer operation and a cleaning operation and wherein said controlling means controls the cleaning operation of said rotatable member before the start of the image forming operation.

27. A device according to claim 24, wherein said recording member is a rotatable member which is subjected to a latent image forming operation, a developing operation and an image transfer operation, wherein said recording member is rotated before the start of the image forming operation, and wherein said controlling means controls the rotation of said recording member before the start of the image forming operation.

28. A device according to claim 24, wherein said recording member is a rotatable member which is subjected to a latent image forming operation, a developing operation and an image transfer operation wherein a wetting means wets the surface of said recording member before the start of the latent image forming operation, and wherein said controlling means controls the rotation of said recording member before the start of the image forming operation.

29. An image formation apparatus comprising:

image forming means including means for forming a latent image on a recording member and means for developing the latent image with a liquid developer;

means for detecting the concentration of the developer;

means for generating a signal corresponding to the downtime of the image formation apparatus using the concentration of developer detected by said detecting means; and means for controlling said image forming means in response to the signal generated by said signal generating means, said controlling means controlling a time period, in accordance with the downtime, measured from the time when a power switch of the apparatus is turned on to the time when the operation of said image forming means is enabled.

30. An apparatus according to claim 29, wherein said recording member is a rotatable member which is subjected to a latent image forming operation, a developing operation, an image transfer operation and a cleaning operation, and wherein said controlling means controls the cleaning operation of said recording member before the start of the image forming operation.

31. An apparatus according to claim 29, wherein said recording member is a rotatable member which is subjected to a latent image forming operation, a developing operation and an image transfer operation, and wherein said apparatus further comprises a cleaning blade for cleaning a surface of said recording member for repetitive use, wetting means for wetting the surface of said recording member, and means for rotating said recording member before the start of the latent image forming operation, said controlling means controlling said rotating means and said wetting means to rotate, for a predetermined period of time, said recording member before the start of the latent image forming operation to allow said cleaning blade to clean, when the developer concentration is not more than a predetermined value, the surface of the recording member as the surface is wetted.

* * * * *